US011420847B2

(12) United States Patent
Kalliomaki et al.

(10) Patent No.: US 11,420,847 B2
(45) Date of Patent: Aug. 23, 2022

(54) MOBILE OPERATING UNIT, ELEVATOR AND METHOD

(71) Applicant: Kone Corporation, Helsinki (FI)

(72) Inventors: Jaakko Kalliomaki, Helsinki (FI); Juha-Matti Aitamurto, Helsinki (FI); Jari Kantola, Helsinki (FI); Jukka Lindberg, Helsinki (FI); Pekka Laukkanen, Helsinki (FI)

(73) Assignee: Kone Corporation, Helsinki (FI)

( * ) Notice: Subject to any disclaimer, the term of this patent is extended or adjusted under 35 U.S.C. 154(b) by 228 days.

(21) Appl. No.: 16/834,091

(22) Filed: Mar. 30, 2020

(65) Prior Publication Data

US 2020/0339387 A1 Oct. 29, 2020

(30) Foreign Application Priority Data

Apr. 26, 2019 (EP) ..... 19171382

(51) Int. Cl.
*B66B 5/00* (2006.01)
*B66B 1/46* (2006.01)
*B66B 11/04* (2006.01)

(52) U.S. Cl.
CPC ..... *B66B 5/0087* (2013.01); *B66B 1/46* (2013.01); *B66B 11/0415* (2013.01); *B66B 5/005* (2013.01)

(58) Field of Classification Search
CPC ..... B66B 5/0087; B66B 5/0025; B66B 1/46; B66B 11/0415; B66B 5/005
See application file for complete search history.

(56) References Cited

U.S. PATENT DOCUMENTS

2004/0094366 A1* 5/2004 Weinberger ..... B66B 5/0025 187/247
2014/0069745 A1* 3/2014 Dellarippa ..... B66B 5/0087 187/381
2018/0273344 A1* 9/2018 Mason ..... G08B 25/08
2018/0332368 A1* 11/2018 Copeland ..... B66B 5/0087
2020/0339387 A1* 10/2020 Kalliomaki ..... B66B 5/0087
2021/0032078 A1* 2/2021 Chiappa ..... B66B 5/0025

FOREIGN PATENT DOCUMENTS

DE 102016102668 A1 8/2017
EP 3438034 A1 2/2019
WO WO-2016207706 A1 12/2016

OTHER PUBLICATIONS

European Search Report for Application No./Patent No. 19171382.5-1017, dated Oct. 11, 2019.

* cited by examiner

*Primary Examiner* — Michael A Riegelman
(74) *Attorney, Agent, or Firm* — Harness, Dickey & Pierce, P.L.C.

(57) ABSTRACT

The invention relates to a mobile operating unit for an elevator, comprising an operating interface manually operable by a user to control movement of an elevator car; and an orientation sensor for sensing orientation of the operating unit. The invention also relates to an elevator comprising said mobile operating unit and a method for monitoring elevator wherein said mobile operating unit is used.

20 Claims, 3 Drawing Sheets

MOBILE OPERATING UNIT, ELEVATOR AND METHOD

RELATED APPLICATIONS

This application claims priority to European Patent Application No. EP 19171382.5 filed on Apr. 26, 2019, the entire contents of which are incorporated herein by reference.

FIELD OF THE INVENTION

The invention relates to manual control of movement of an elevator car, wherein the elevator preferably is an elevator for vertically transporting passengers and/or goods.

BACKGROUND OF THE INVENTION

Modern elevators typically have a normal operation mode and a service operation mode. In the normal operation mode, movement of the car between vertically displaced landings in response to calls received from passengers elevator is automatically controllable by the control system. In the service operation mode, movement of the car is manually controllable by a user with an operating unit located inside the hoistway. The operating unit is not available to use for passengers of the elevator. Typically the operating unit is located on top of the car roof or in the pit of the hoistway.

The operating unit has buttons, also referred to as manual drive buttons, which are manually operable by a user to control movement of an elevator car. With these drive buttons manual service drive is possible with low speed (for example 0.3 m/s). Car starts to move when drive buttons are pushed and stops when buttons are released. To enable manual drive, selection switch in the inspection station must first be turned into service mode position. It must be returned back to original position before normal elevator operation is possible.

Traditionally, said operating unit has been fixed to its position in a non-movable manner. This may cause practical problems and be non-ergonomic for the service personnel. Therefore an operating unit that is mobile has been introduced. Said mobility can be facilitated by non-fixed mounting of the operating unit. The power and signal connection between the operating unit and the elevator controls system can be provided by aid of a flexible cable. It has been noted that the mobility may cause new safety risks, since misplacing of the unit after usage can lead to various hazards. These can be for instance, leaving the unit under overspeed governor tension weight, which may render the overspeed governor inoperable due to rope stretch, or leaving the unit in such a place that it is damaged by a moving elevator car or counterweight, or leaving the unit lying on the pit such that it can cause tripping.

BRIEF DESCRIPTION OF THE INVENTION

The object of the invention is to provide a mobile operating unit, an elevator, and a method, which are improved in terms of safety related to placing of a mobile operating unit after usage thereof. An object is particularly to alleviate one or more of the above defined drawbacks of prior art and/or problems discussed or implied elsewhere in the description. An object is to achieve this with simple structure, with small amount of components and with high reliability.

Embodiments are presented, inter alia, which provide a high level of mobility in use, as well as good suitability for different elevator layouts. Embodiments are presented, inter alia, which can be placed after use in a predetermined safe location structurally simply and economically. Embodiments are presented, inter alia, which can serve safely also if a separate station for the mobile operating unit is not in use or available.

It is brought forward a new mobile operating unit for an elevator, comprising an operating interface manually operable by a user to control movement of an elevator car; and an orientation sensor for sensing orientation of the operating unit. With this solution, one or more of the above mentioned advantages and/or objectives are achieved.

One advantage is that the mobile operating unit can provide information indicating the orientation of the mobile operating unit, such as to an elevator control system. The orientation of the mobile operating unit is usable as indication whether the mobile operating unit is after usage thereof left lying around or whether it is placed in a predetermined orientation. This increases safety since the elevator control system can be configured allow or prevent elevator functions based on orientation of the operating unit. Such functions to be prevented or allowed can include normal elevator operation, for instance.

Preferable further features are introduced in the following, which further features can be combined with the mobile operating unit individually or in any combination.

In a preferred embodiment, the mobile operating unit is provided for being connected to an elevator control system. Preferably, the mobile operating unit comprises an output for outputting signals, in particular via a wired or wireless connection, from the mobile operating unit to an elevator control system. Such signals can include manual operation signals, such as signals for the elevator control to move of the elevator car upwards or downwards and/or signals from the orientation sensor.

In a preferred embodiment, the mobile operating unit comprises a power input.

In a preferred embodiment, the operating unit is elongated in shape.

In a preferred embodiment, the operating unit comprises a non-planar side face comprising a tip for making the operating unit unstable when standing on its non-planar side face.

In a preferred embodiment, a flexible cable for transmitting power to and/or signal(s) from the mobile operating unit is connected to the mobile operating unit. It can protrude from mobile operating unit, preferably from one end of the operating unit when it is elongated in shape, for instance.

In a preferred embodiment, the operating unit is tiltable around one or more horizontal axes pointing in different directions.

In a preferred embodiment, the state of the orientation sensor is changeable between a first state and a second state by tilting the operating unit around one or more horizontal axes, most preferably around anyone of at least two horizontal axes pointing in different directions, such as in orthogonal directions.

In a preferred embodiment, the orientation sensor has a first state when the operating unit is in a first attitude and a second state when the operating unit is in a second attitude.

Preferably, when the operating unit is in the first attitude, an axis of the operating unit, which is preferably a longitudinal axis thereof, points in a first direction, and when the operating unit is in the second attitude said axis of the operating unit points in a second direction.

In a preferred embodiment, the operating unit is elongated in shape, and said first attitude is an upright attitude, and said second attitude is a tilted attitude. More specifically, when the operating unit is in the upright attitude, the longitudinal axis of the operating unit points in a first direction, the first direction being vertical or at least substantially vertical direction, and when the operating unit is in the tilted attitude the longitudinal axis of the operating unit points in a second direction, the second direction being a direction angularly displaced from said first direction, such as horizontal or at least substantially horizontal direction.

In a preferred embodiment, the first state is an electrically conducting state and the second state is electrically non-conducting state, or vice versa.

In a preferred embodiment, the orientation sensor comprises a movable electrically conductive contact, such as a solid contact member or fluid contact substance for example, which is arranged to be pulled by gravity to close a circuit, such as to move to electrically connect two conductors, when the operating unit is in the first attitude, and to be pulled by gravity to break the circuit, such as to move to electrically disconnect said two conductors, when the operating unit is in the second attitude, or vice versa. Preferably, the contact is in a closed space where it can move into and out of simultaneous contact with two conductors. Preferably, said solid contact member is a ball, such as a metal ball for example, which is advantageous since such a member can be rolled by gravity to break and to close a circuit. Alternatively, said contact is fluid contact substance, which is advantageous since such a substance can flow moved by gravity to break and to close a circuit.

In an embodiment, the orientation sensor may be an acceleration sensor, a gyroscope and/or a corresponding MEMS orientation sensor. Signal(s) indicating orientation sensor state may be sent from the operating unit to the elevator control via one more buses. Optionally, the operating unit may comprise a relay as well as a processor, a comparator or corresponding evaluation circuit. The evaluation circuit may be configured to compare state of the orientation sensor to a predetermined orientation criteria, and to control the relay on the basis of the comparison. Relay output may be wired from the operating unit to the elevator control, to communicate attitude of the operating unit to the elevator control.

In a preferred embodiment, the orientation sensor is or at least comprises a mercury switch.

In a preferred embodiment, the mobile operating unit comprises at least a first button for being pressed by a user to signal the elevator control to move of the elevator car upwards, and a second button for being pushed by a user to signal the elevator control to move of the elevator car downwards.

In a preferred embodiment, the mobile operating unit is equipped with a holder for holding the mobile operating unit in the aforementioned first attitude. Preferably, the mobile operating unit can be temporarily parked on the holder when not in use, and the mobile operating unit can be removed from the holder when the mobile operating unit operating unit is taken into use. Preferably, the holder comprises a pocket for receiving the mobile operating unit, the pocket being preferably provided with by plurality stop faces blocking lateral and downwards directed vertical movement of the operating unit inserted into the pocket, such as walls and a bottom.

It is also brought forward a new elevator comprising an elevator car and a mobile operating unit as described anywhere above or in anyone of the claims. The elevator is configured to prevent normal elevator operation if orientation of the operating unit sensed by aid of the orientation sensor does not fulfil one or more predefined criteria. With this solution, one or more of the above mentioned advantages and/or objectives are achieved.

One advantage is that elevator safety is improved, because normal elevator is not started after usage of the mobile operating unit in a case where the mobile operating unit is oriented such that it is likely left lying around.

Preferable further features have been introduced above as well as in the following, which further features can be combined with the elevator individually or in any combination.

In a preferred embodiment, the elevator comprises a control system for controlling movement of the elevator car.

In a preferred embodiment, in the normal elevator operation the elevator serves passengers.

In a preferred embodiment, in the normal elevator operation, movement of the car between vertically displaced landings, preferably in response to calls received from passengers, is automatically controllable by the control system.

In a preferred embodiment, the elevator is operable by normal elevator operation and by service operation.

In a preferred embodiment, in the service operation movement of the car is manually controllable by a user with the operating unit.

In a preferred embodiment, said mobile operating unit is connected with the control system, preferably via one more buses, for transmitting signal(s) from the operating interface and/or from the orientation sensor.

In a preferred embodiment, the elevator comprises a holder for holding the operating unit such oriented, in particular in such an attitude, that the one or more predefined criteria are fulfilled.

In a preferred embodiment, the elevator is configured to move the car upwards in response to press of the first button by the user, and downwards in response to press of the second button by the user, and to stop each said movement when the press of the button in question stops.

In a preferred embodiment, the elevator control system is configured to control movement of the car in response to signal(s) received from the operating unit, such as by rotating a motor for rotating a drive sheave around which passes a roping connected with the car, for example.

In a preferred embodiment, the operating unit is elongated in shape, and said one or more predefined criteria include at least that the operating unit is in upright position, i.e. where the longitudinal axis thereof points in vertical or at least substantially vertical direction.

In a preferred embodiment, the operating unit is disposed inside an elevator hoistway, separately from the car. Preferably then, the operating unit is disposed in the pit of the hoistway.

In a preferred embodiment, the operating unit is carried by the car, such as on top the roof of the elevator car.

It is also brought forward a new method for monitoring elevator, which elevator comprises an operating unit manually operable by a user to control movement of an elevator car, which operating unit is as described anywhere above or in anyone of the claims. The method comprises sensing orientation of the operating unit, and if the orientation does not fulfil one or more predefined criteria, preventing normal elevator operation.

With this solution, one or more of the above mentioned advantages and/or objectives are achieved.

One advantage is that elevator safety is improved, because normal elevator is not started after usage of the mobile operating unit is a case where the mobile operating unit is oriented such that it is likely left lying around.

Preferable further features have been introduced above as well as in the following, which further features can be combined with the method individually or in any combination.

In a preferred embodiment, the elevator is as described anywhere above or in anyone of the claims.

In a preferred embodiment, said sensing orientation of the operating unit is performed by aid of the orientation sensor.

In a preferred embodiment, the method comprises determining whether the orientation fulfils one or more predefined criteria.

In a preferred embodiment, if the orientation fulfils at least said one or more predefined criteria, and possibly also if one or more other predefined criteria are fulfilled, the method comprises allowing normal elevator operation.

In a preferred embodiment, the elevator mentioned anywhere above has a normal operation mode, in particular wherein the elevator is operable by normal elevator operation, and a service operation mode, in particular wherein the elevator is operable by service operation.

The elevator is preferably such that it comprises an elevator car vertically movable between two or more vertically displaced landings during said normal operation. During said service operation, the car can preferably be driven by the manual control to any location between the uppermost and lowermost landing and stopped there, i.e. also to a location where the sill of the car is not level with a sill of a landing. Preferably, the car has an interior space suitable for receiving a passenger or passengers, and the car can be provided with a door for forming a closed interior space, such as an automatic door.

In general, shape of the operating unit may be selected such that when laid down, the operating unit tends to orientate into or towards a certain attitude. The one or more predefined criteria are then preferably selected such that they are not fulfilled when the operating unit is in said certain attitude. The elongated shape is one such shape, since it tends to tilt easily into a horizontal attitude when placed to stand. At least one side of the operating unit could be rounded, for example half-round, which makes the operating unit tend to tilt easily when placed to stand on the rounded side. In one alternative, the operating unit could be a hemisphere, for instance. In one alternative, the operating unit could have a flat side.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
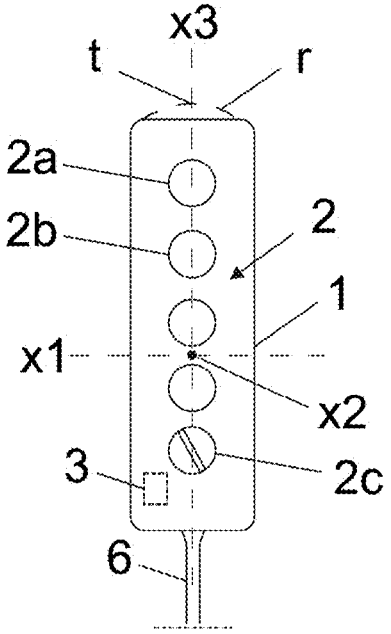
FIG. 1 illustrates a mobile operating unit for an elevator according to an embodiment in an upright attitude.

FIG. 1 illustrates a mobile operating unit 1 for an elevator according to an embodiment. The mobile operating unit 1 (later also referred to as an operating unit 1) comprises an operating interface 2 manually operable by a user to control movement of an elevator car; and an orientation sensor 3 for sensing orientation of the operating unit 1.

Presence of an orientation sensor 3 facilitates that an elevator control system 10 can obtain information indicating the orientation of the mobile operating unit 1 is. The orientation of the mobile operating unit 1 is usable as indication whether the mobile operating unit 1 is left lying around or whether it is placed in a predetermined orientation. This increases safety since, the elevator control system 10 can be configured allow or prevent elevator functions based on orientation of the operating unit. Such functions to be prevented or allowed can include normal elevator operation, for instance.

In the embodiment of FIG. 1, the operating unit 1 is elongated in shape, which is preferable since this with kind of shape the orientation is most meaningful and relevant for safety. Since it is unlikely to place a mobile operating unit 1 of this kind unintentionally to stand in an upright attitude, orientation thereof can be used as an indicator of safety of its positioning. Positioning of an elongated operating unit 1 in an upright position requires an amount of concentration telling the elevator system 10 that it has not been forgotten by the service person lying around.

The operating unit 1 can have a non-planar side face r comprising a tip t for making the operating unit 1 unstable when standing on its non-planar side face r. The operating unit 1 is hereby arranged to tilt, when placed to stand its non-planar face r against a planar horizontal face, such as a floor face. The non-planar shape is optional and illustrated with broken line in FIG. 1. The non-planar side face r is preferably rounded. The increased instability of the operating unit 1 increases the need of the service person to concentrate such that he is likely to position the operating unit 1 in a holder or other safe position in correct attitude.

The orientation sensor 3 preferably changes state according to its orientation, and thereby according to the orientation of the operating unit 1 comprising it. Preferably, particularly, the orientation sensor 3 has a first state when the operating unit 1 is in a first attitude and a second state when the operating unit 1 is in a second attitude. In the preferred embodiments, said first attitude is an upright attitude and a second attitude is a tilted attitude. Preferably, the state of the orientation sensor is changeable between a first state and a second state by tilting the operating unit 1 around a horizontal axis x1,x2 from an upright attitude to a tilted attitude. More particularly, it is preferable that the state of the orientation sensor is changeable between the first state and the second state by tilting the operating unit 1 around anyone of at least two horizontal axes x1,x2. Since there can be differently oriented horizontal axes, it is preferable that tilting around anyone of them, can cause change of state of the of the orientation sensor 3. Thus, no unsafe state can follow tilting regardless of where on a horizontal plane the axis in question points. In the preferred embodiment illustrated, the at least around two horizontal axes x1,x2 point on a horizontal plane in different directions, in this case in orthogonal directions.

Figure 2:
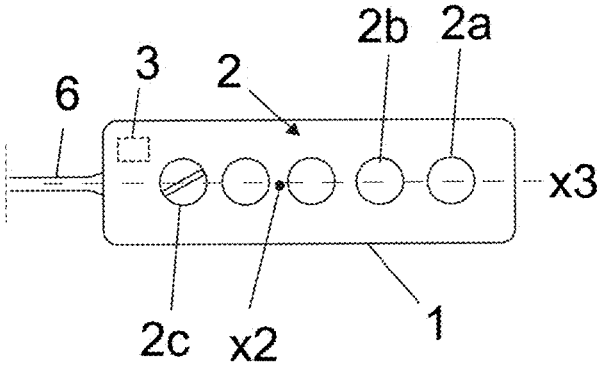
FIG. 2 illustrates the mobile operating unit of FIG. 1 in a tilted attitude.
Figure 3:
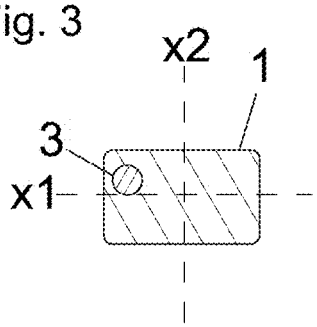
FIG. 3 illustrates a preferred cross section of the mobile operating unit of FIG. 1 at the point of the orientation sensor.

FIG. 1 illustrates the operating unit 1 in the first attitude, which is in this case an upright attitude, wherein the longitudinal axis x3 thereof points in vertical direction. FIG. 2 illustrates the operating unit 1 is in a second attitude, which is in this case a tilted attitude, wherein the longitudinal axis x3 thereof points in direction angularly displaced from vertical direction. In FIG. 2, the operating unit 1 has been tilted around the horizontal axis x2 such that the longitudinal axis x3 thereof points in horizontal direction.

The mobile operating unit 1 is moreover such that it comprises a first button 2*a* for being pressed by a user to signal the elevator control to move of the elevator car upwards, and a second button 2*b* for being pushed by a user to signal the elevator control to move of the elevator car downwards.

The mobile operating unit 1 is moreover such that it comprises a selection switch 2*c* for selecting between normal operation mode and service operation mode. In FIG. 1, the selection switch 2*c* is a rotatable switch.

Figure 4:
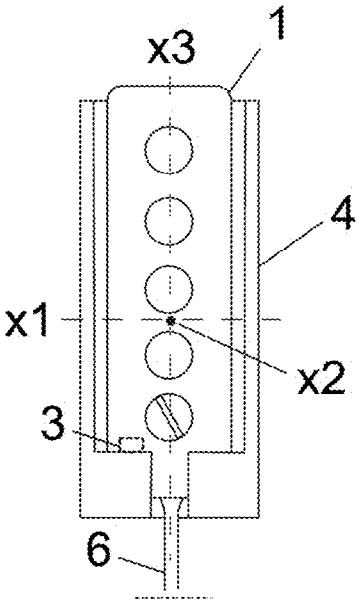
FIG. 4 illustrates a mobile operating unit for an elevator according to an embodiment in a holder holding it in an upright attitude.
Figure 5:
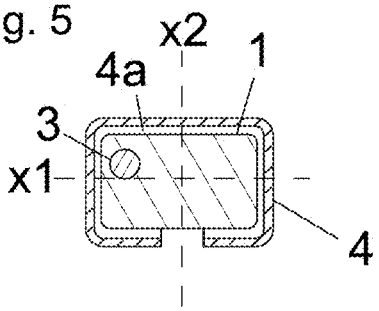
FIG. 5 illustrates a preferred cross section of the mobile operating unit and the holder of FIG. 4.

As illustrated in FIG. 4, the mobile operating unit 1 can be equipped with a holder 4 for holding the mobile operating unit 1 in the first attitude, i.e. in the aforementioned upright attitude in the embodiment according to the preferred examples.

The holder 4 is such that the mobile operating unit 1 can be temporarily parked on it when not in use, and such that the mobile operating unit 1 can be removed from the holder 4 when the mobile operating unit 1 is taken into use. In the preferred embodiment illustrated, the holder 4 comprises a pocket 4*a* for receiving the mobile operating unit 1. In FIG. 4, the mobile operating unit 1 has been inserted in said pocket 4*a*. The holder 4 can be mounted immovably in the hoistway, such as on top the roof of the elevator car 5, or on a fixed structure in the pit of the hoistway 7.

Figure 6:
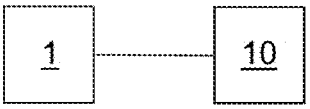
FIG. 6 illustrates a preferred connection between the mobile operating unit and an elevator control system.

The mobile operating unit 1 is provided for being connected to an elevator control system 10. FIG. 6 illustrates such a connection. Generally, said connection can be wired or wireless. Over the connection, preferably signals can be transmitted from the operating unit 1 to the elevator control system 10. Such signals can include manual operation signals, such as signals for the elevator control to move of the elevator car upwards or downwards, and/or signals from the orientation sensor 3. For the purpose of facilitating said connection, the mobile operating unit 1 comprises an output for outputting signals from the mobile operating unit 1 to an elevator control system 10. The mobile operating unit 1 moreover comprises an input for inputting power thereto, in particular electricity. In the embodiment of FIG. 1, a flexible cable 6 for transmitting power to and signal(s) from the mobile operating unit 1 is connected to the mobile operating unit 1. The cable 6 can comprise separate wires for power supply and for signal transmission, the power supply wire being connected to the aforementioned input, and the wire for signal transmission to the aforementioned output. Alternatively, signal transmission may be implemented by means of carrier wave via the power supply wire.

Figure 7:
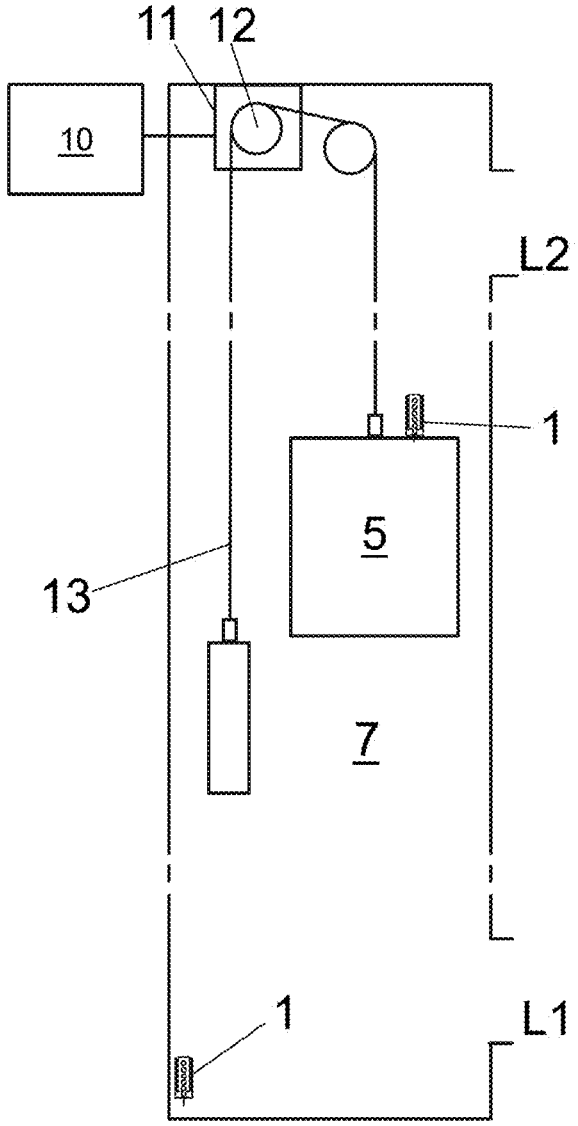
FIG. 7 illustrates a preferred embodiment of an elevator.

FIG. 7 illustrates an elevator comprising an elevator car 5, vertically movable in an elevator hoistway 7, and a mobile operating unit 1 as described referring to FIGS. 1-6. The elevator is configured to prevent normal elevator operation if orientation of the operating unit 1 sensed by aid of the orientation sensor 3 does not fulfil one or more predefined criteria.

The elevator comprises a control system 10 for controlling movement of the elevator car 5. The elevator is operable by normal elevator operation and by service operation. In the normal elevator operation movement of the car 5 between vertically displaced landings L1,L2 in response to calls received from passengers elevator is automatically controllable by the control system 10. In the service operation movement of the car 5 is manually controllable by a user with the operating unit 1.

Said mobile operating unit 1 is connected with the control system 10 via one more buses for transmitting signal(s) from the operating interface 2 and/or from the orientation sensor 3.

In FIG. 7, it is illustrated two alternative preferred positions for the mobile operating unit 1. The elevator could have a mobile operating unit 1 in either or both of these positions, or possibly elsewhere inside or in proximity of the hoistway 7.

In the embodiment of FIG. 7, the elevator has an operating unit 1 is disposed inside the elevator hoistway 7, separately from the car 5. Thus, it does not travel with the car 5, and it is operable by a person not being onboard the car 5. The operating unit 1 in question is particularly disposed in the pit of the hoistway 7.

In the embodiment of FIG. 7, the elevator has an operating unit 1 carried by the car 5. Thus, it travels with the car 5, and it is operable by a person standing onboard the car 5.

In FIG. 7, the elevator comprises a holder 4 for holding each said mobile operating unit 1 such oriented, i.e. in such an attitude, that the one or more predefined criteria are fulfilled. In FIG. 7, said attitude is upright attitude mentioned and illustrated referring to FIGS. 1-5. The elevator comprises a holder 4 mounted in the hoistway, on top the roof of the elevator car 5 holding the operating unit 1 carried by the car 5 such oriented, i.e. in such an attitude, that the one or more predefined criteria are fulfilled. The elevator comprises a holder 4 mounted immovably in the hoistway, on a fixed structure in the pit of the hoistway 7 holding the operating unit 1 carried by the car 5 such oriented, i.e. in such an attitude, that the one or more predefined criteria are fulfilled.

The elevator is configured to move the car 5 upwards in response to press of the first button 2*a* of the mobile operating unit 1 by a user, and downwards in response to press of the second button 2*b* mobile operating unit 1 by a user, and to stop each said movement when the pressing of the button 2*a*,2*b* in question stops.

The elevator control system 10 is configured to control movement of the car 5 in response signal(s) received from the operating unit 1 by controlling rotation of a motor 11 for rotating a drive sheave 12 around which passes a roping 13 connected to the car 5.

The mobile operating unit 1 is preferably elongated in shape, and said one or more predefined criteria include at least that the operating unit 1 is in upright position, i.e. where the longitudinal axis x3 thereof points in vertical or at least substantially vertical direction. With said at least substantially vertical direction it is meant direction less than 10 degrees angularly displaced from vertical direction.

In a method for monitoring elevator, according to an embodiment, the elevator comprises a mobile operating unit 1 manually operable by a user to control movement of an elevator car 5, which operating unit as described referring to FIGS. 1-6, the elevator being as described referring to FIG. 7.

The method comprises sensing orientation of the mobile operating unit 1, and if the orientation does not fulfil the one or more predefined criteria, preventing normal elevator operation.

The sensing is performed by aid of the orientation sensor 3 comprised in the mobile operating unit 1.

The method moreover comprises determining whether the orientation fulfils one or more predefined criteria.

If the orientation fulfils at least said one or more predefined criteria, and possibly also if one or more other predefined criteria are fulfilled, the method comprises allowing normal elevator operation.

Figure 8:
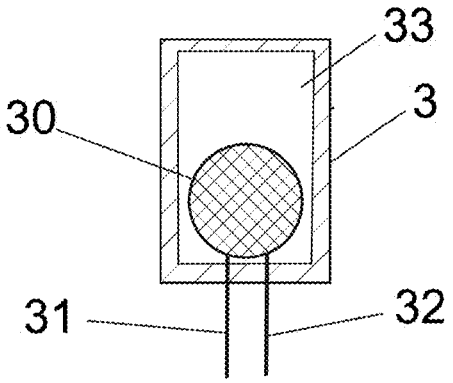
FIG. 8 illustrates preferred further details of the orientation sensor in a situation where the orientation sensor is in upright attitude.
Figure 9:
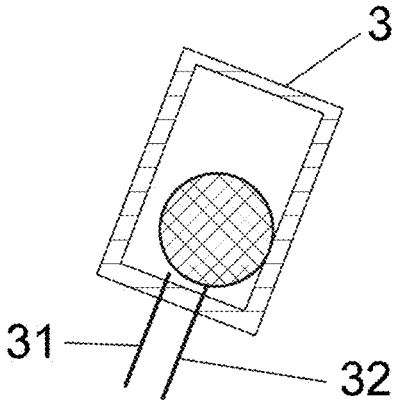
FIG. 9 illustrates preferred further details of the orientation sensor in a situation where the orientation sensor is in tilted attitude.

FIGS. 8 and 9 illustrate preferred further details of the orientation sensor 3. In this embodiment, the first state of the orientation sensor 3 is illustrated in FIG. 8, where the first state is an electrically conducting state and the second state is illustrated in FIG. 8, where the second state is electrically non-conducting state.

In the preferred embodiment, the orientation sensor 3 has the first state when the operating unit 1 is in a first attitude namely preferably in an upright attitude and the second state when the operating unit 1 is in a second attitude namely preferably a tilted attitude.

The orientation sensor 3 comprises a movable electrically conductive contact 30. The contact 30 is in the illustrated embodiment a solid member, more particularly a ball comprising metal, but it could alternatively be a fluid contact substance. The contact 30 is arranged to be pulled by gravity to close a circuit, in particular to move to electrically connect two conductors 31,32, when the operating unit 1 is in the first attitude, and to be pulled by gravity to break the circuit, such as to move to electrically disconnect said two conductors 31,32, when the operating unit 1 is in the second attitude, or vice versa. The contact 30 is disposed in a closed space 33 where it can move into and out of simultaneous contact with the two conductors 31,32.

In the electrically conducting state of FIG. 8, the contact 30 rests pulled by gravity against two conductors 31,32 electrically connecting them and closing a circuit partially formed by the two conductors 31,32. In the electrically non-conducting state of FIG. 9, the orientation sensor 3 has been tilted together with the operating unit such that the contact 30 has been pulled by gravity away from simultaneous contact with the two conductors 31,32. A gap has been formed between a conductor 31 and the contact 30. Thereby, the contact 30 does not electrically connect the two conductors 31,32 and the circuit partially formed by the two conductors 31,32 is broken.

As an alternative to the solution where contact 30 is a solid member, the contact 30 is a fluid contact substance. In this type of alternative, it is preferred that the orientation sensor 3 is a mercury switch, since these are widely available and known to be reliable.

Generally, the contact 30 can comprise metal, but this is not necessary, since also non-metallic materials and substances can be electrically conducting.

The elevator illustrated in FIG. 7 is a counterweighted elevator. However, this is not necessary since the invention can also be implemented in counterweighless elevators. The hoisting function of the elevator illustrated in FIG. 7 is implemented with a hoisting roping. This is however not necessary since the invention can also be implemented in elevators where hoisting is different, such as in hydraulic elevators, or in elevators with magnetically levitating elevator cars.

Figure 10:
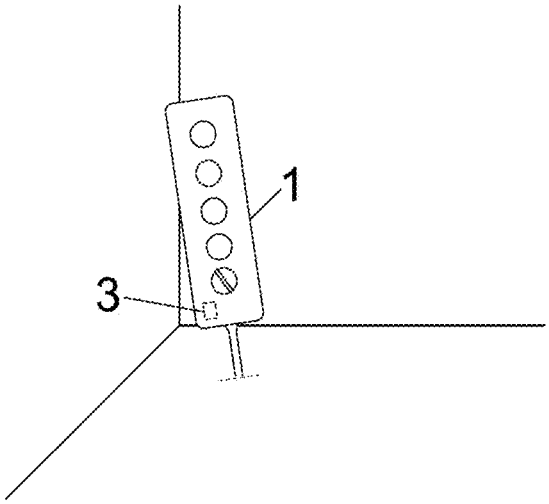
FIGS. 10 and 11 illustrate alternative ways to position the mobile operating unit such that it is in upright position.
Figure 11:
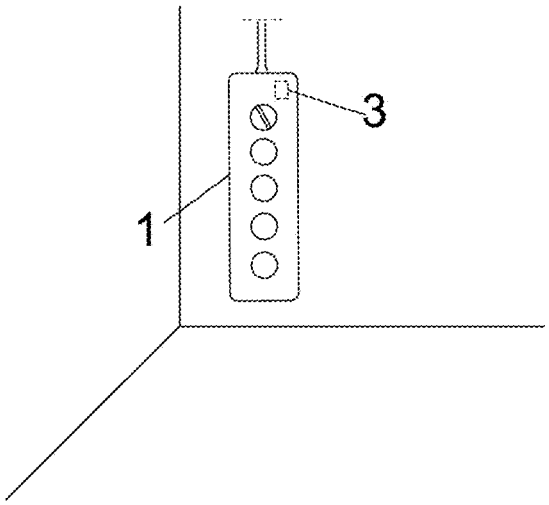

One advantage of the mobile operating unit 1 provided with an orientation sensor 3 is that it does not necessitate a holder or at least not a complicated holder. This makes the mobile operating unit 1, the method and elevator described in this application simply usable with different elevator layouts and configurations. The mobile operating unit 1 can for instance be used in one elevator with a holder and in another elevator without a holder. FIGS. 10 and 11 illustrate possible ways to position the mobile operating unit 1 such that it is upright or at least substantially upright attitude, which is in this case the aforementioned predetermined attitude where the one or more predetermined criteria are fulfilled. Placement of an elongated mobile operating unit 1 in this way, even without a holder 4, requires concentration telling the elevator system 10 that it has not been forgotten by the service person lying around. More specifically, FIG. 10 illustrates that the elongated mobile operating unit 1 has been placed to lean against a wall of the hoistway 7 in substantially upright attitude. FIG. 11 illustrates that the elongated mobile operating unit 1 has been placed to hang from its cable 6 in upright attitude.

Generally, the elevator the elevator can have a normal operation mode, in particular wherein the elevator is operable by said normal elevator operation, and a service operation mode, in particular wherein the elevator is operable by said service operation. The elevator control system can control switching between these modes, e.g. based on criteria including the aforementioned one or more criteria, but possibly also other criteria.

Generally, it is not necessary, even though preferable, that the operating unit 1 is longitudinal since some the advantages of the invention may be achieved also with different shapes.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims.

The invention claimed is:

1. A mobile operating terminal configured to control movement of an elevator car of an elevator, the mobile operating terminal comprising:

an operating interface manually operable by a user to control the movement of the elevator car; and an orientation sensor configured to sense an orientation of the mobile operating terminal, wherein the movement of the elevator car is controlled based on the orientation of the mobile operating terminal.

2. The mobile operating terminal according to claim 1, wherein the mobile operating terminal is configured to connect to an elevator controller.

3. The mobile operating terminal according to claim 1, wherein the mobile operating terminal is elongated in shape.

4. The mobile operating terminal according to claim 1, wherein the mobile operating terminal is tiltable around one or more horizontal axes.

5. The mobile operating terminal according to claim 4, wherein the orientation sensor is changeable between a first state and a second state by tilting the mobile operating terminal around the one or more horizontal axes.

6. The mobile operating terminal according to claim 5, wherein the orientation sensor has the first state when the mobile operating terminal is in a first attitude and the second state when the mobile operating terminal is in a second attitude.

7. The mobile operating terminal according to claim 6, wherein the mobile operating terminal is elongated in shape such that the first attitude is an upright attitude, and the second attitude is a tilted attitude.

8. The mobile operating terminal according to claim 6, wherein the orientation sensor comprises:

a movable electrically conductive contact configured to position to electrically connect two conductors, when the mobile operating terminal is in the first attitude, and to position to electrically disconnect the two conductors, when the mobile operating terminal is in the second attitude.

9. The mobile operating terminal according to claim 5, wherein the first state is an electrically conducting state and the second state is electrically non-conducting state.

10. The mobile operating terminal according to claim 1, wherein the mobile operating terminal comprises:

a first button pressable by the user to signal an elevator controller to move the elevator car upwards, and a second button pressable by the user to signal the elevator controller to move the elevator car downwards.

11. The mobile operating terminal according to claim 1, wherein the mobile operating terminal comprises:

a selection switch to signal an elevator controller to switch between a normal operation mode and a service operation mode.

12. An elevator comprising:

the mobile operating terminal of claim 1; and the elevator car, wherein the elevator is configured to prevent a normal elevator operation if orientation of the mobile operating terminal sensed by aid of the orientation sensor does not fulfil one or more criteria.

13. The elevator according to claim 12, further comprising:

an elevator controller configured to control the movement of the elevator car.

14. The elevator according to claim 13, wherein the elevator controller is configured to automatically control movement the elevator car between vertically displaced landings, when the elevator is operating in the normal elevator operation.

15. The elevator according to claim 12, further comprising:

a holder configured to hold the mobile operating terminal oriented such that the one or more criteria are fulfilled.

16. The elevator according to claim 12, wherein the elevator is configured to, move the elevator car in response to press of a button by the user, and stop movement of the elevator car when the user releases the button.

17. The elevator according to claim 12, wherein the mobile operating terminal is elongated in shape, and the one or more criteria include at least that the mobile operating terminal is in upright position where a longitudinal axis thereof points is substantially vertical direction.

18. The mobile operating terminal of claim 1, wherein the mobile operating terminal is configured to instruct an elevator controller to prevent the movement of the elevator during a normal elevator operation, in response to the orientation sensor sensing that the mobile operating terminal does not fulfill one or more criteria.

19. The mobile operating terminal of claim 18, wherein the mobile operating terminal is shaped such that the mobile operating terminal is configured to dock in a holder such that the orientation of the mobile operating terminal fulfils the one or more criteria.

20. A method of monitoring an elevator, the method comprising:

sensing an orientation of a mobile operating terminal via an orientation sensor configured to sense the orientation of the mobile operating terminal, the mobile operating terminal including an operating interface manually operable by a user to control movement of an elevator car; and preventing a normal elevator operation, in response to the orientation sensor sensing that the orientation of the mobile operating terminal does not fulfill one or more criteria.

* * * * *